United States Patent [19]

Oliff

[11] 4,192,540

[45] Mar. 11, 1980

[54] ARTICLE CARRIER BLANK

[75] Inventor: James R. Oliff, Austell, Ga.

[73] Assignee: The Mead Corporation, Dayton, Ohio

[21] Appl. No.: 962,611

[22] Filed: Nov. 21, 1978

[51] Int. Cl.[2] ..... B65D 71/00; B66F 19/00

[52] U.S. Cl. ..... 294/87.2; 206/161

[58] Field of Search ..... 294/87.2; 206/161, 194, 206/427

[56] References Cited

U.S. PATENT DOCUMENTS

| | | | |
|---|---|---|---|
| 3,156,358 | 11/1964 | Randrup | 294/87.2 |
| 3,767,041 | 10/1973 | Graser | 294/87.2 |

*Primary Examiner*—James B. Marbert

*Attorney, Agent, or Firm*—Walter M. Rodgers; Walter A. Rodgers

[57] ABSTRACT

An article carrier blank comprising a bottom panel (1), a pair of side panels (2,3) foldably joined respectively to the side edges of the bottom panel, a pair of top panels (6,8) foldably joined respectively to the edges of the side panels remote from the bottom panel, a pair of sloping panels (10,12) foldably joined respectively to the edges of the top panels remote from the side panels, a pair of auxiliary top panels (14,16) foldably joined respectively to the edges of the sloping panels remote from the top panels, a neck receiving aperture (40–45) formed in the bottom panel, a transverse retention tab (47) foldably joined to the bottom panel and disposed in the neck receiving aperture, a medial bend line (57) formed in the retention tab and a bend line extension formed in the bottom panel and disposed in alignment with the medial bend line.

8 Claims, 3 Drawing Figures

ARTICLE CARRIER BLANK

TECHNICAL FIELD

This invention relates to an article carrier blank especially adapted for efficiently engaging the upper portions of a plurality of articles in a locked relationship in order to form an economical and sturdy carrier.

BACKGROUND ART

Article carriers of the so-called top gripping variety are known as evidenced by U.S. Pat. Nos. 3,156,358 Randrup; 3,387,879 Wood; and 3,764,001 Graser. Certain prior art top gripping carriers are suitable for use with bottles having so called crimped caps but are not well adapted for use with bottles having resealable caps.

DISCLOSURE OF INVENTION

An article carrier blank comprising a bottom panel, a pair of side panels foldably joined respectively to the longitudinal side edges of the bottom panel, a pair of top panels foldably joined respectively to the longitudinal edges of the side panels remote from the bottom panel, a neck receiving aperture formed in the bottom panel, a transverse retention tab foldably joined to the bottom panel and disposed in the neck receiving aperture, a medial bend line formed in the retention tab, and a bend line extension formed in the bottom panel and disposed in alignment with the medial bend line.

BEST MODE OF CARRYING OUT THE INVENTION

Figure 3:
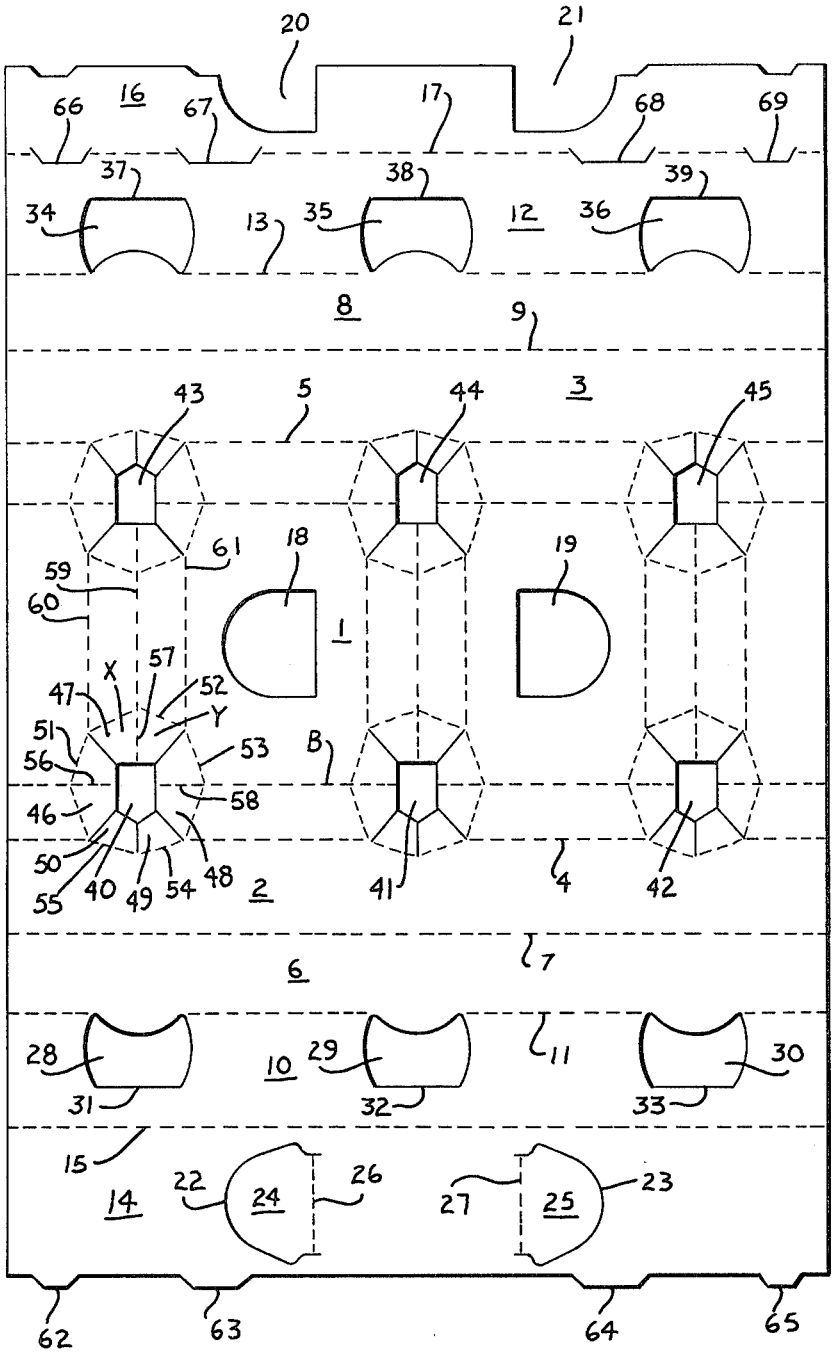
FIG. 3 is a plan view of a blank from which the carrier shown in FIG. 1 is formed.

With reference to the drawings and with particular reference to FIG. 3, the numeral 1 designates the bottom panel of the carrier to the side edges of which side panels 2 and 3 are foldably joined respectively along fold lines 4 and 5. Similarly top panel 6 is foldably joined to side panel 2 along fold line 7 and top panel 8 is foldably joined to side panel 3 along fold line 9.

To complete the basic elements of the blank, sloping panel 10 is foldably joined to top panel 6 along fold line 11 and, likewise, sloping panel 12 is foldably joined to top panel 8 along fold line 13. In addition auxiliary top panel 14 is foldably joined to sloping panel 10 along fold line 15 and auxiliary top panel 16 is foldably joined to sloping panel 12 along fold line 17.

In order conveniently to transport the carrier, finger gripping apertures 18 and 19 are formed in bottom panel 1 and finger gripping notches 20 and 21 are formed in auxiliary top panel 16. Finally finger gripping apertures 22 and 23 defined respectively by cushioning flaps 24 and 25 are formed in auxiliary top panel 14 and are foldably joined respectively thereto along fold lines 26 and 27.

Cap receiving apertures 28, 29 and 30 are formed in sloping panel 10 and are provided respectively with cap engaging edges 31, 32 and 33. In like manner cap receiving apertures 34, 35, and 36 are formed in sloping panel 12 and are provided respectively with cap engaging edges 37, 38, and 39.

According to a feature of this invention, neck receiving apertures 40, 41, 42, 43, 44, and 45 are formed in bottom panel 1. Since each of the neck receiving apertures 40–45 is identically constructed, only neck receiving aperture 40 is here discussed in detail. Specifically neck receiving aperture 40 is provided with retention tabs 46, 47, 48, 49, and 50. Retention tabs 46, 47, and 48 are foldably joined respectively to bottom panel 1 along V-shaped fold lines 51, 52, and 53 and retention tabs 49 and 50 are foldably joined respectively to side panel 2 along fold lines 54 and 55. In addition retention tabs 46, 47 and 48 are provided respectively with medial bend lines 56, 57, and 58 and retention tab 47 is disposed transversely of the blank.

To facilitate entry of the article into neck receiving aperture 40, bend line 59 is formed in bottom panel 1 and constitutes an extension of medial bend line 57 and is disposed in alignment with medial bend line 57 and with one end in coincidence with the apex P of V-shaped fold line 52. Additionally auxiliary bend lines 60 and 61 are formed in bottom panel 1 and extend inwardly of the blank respectively from the ends of V-shaped fold line 52.

Finally tabs 62, 63, 64, and 65 are formed on the outer edge of auxiliary top panel 14 corresponding slots 66, 67, 68, and 69 are formed along fold line 17.

Figure 1:
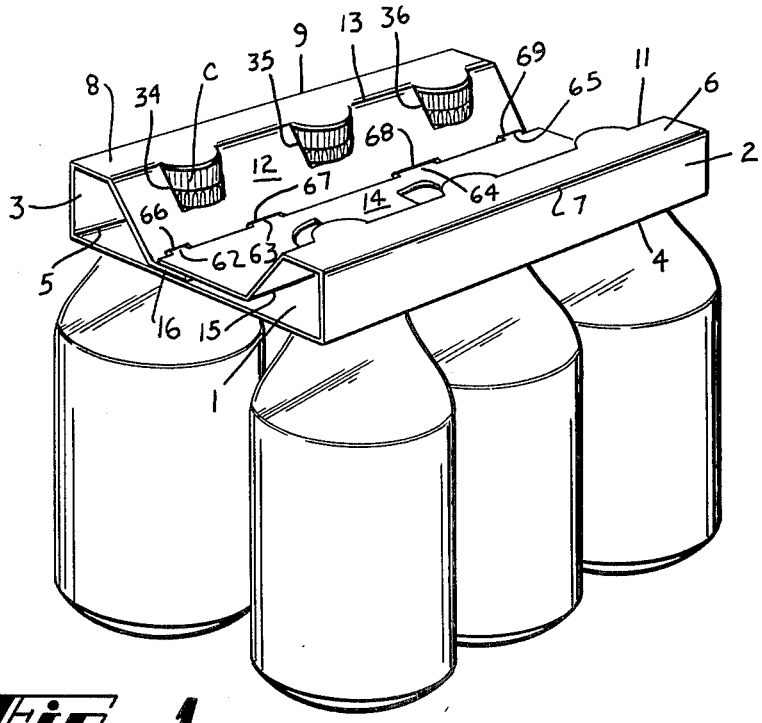
FIG. 1 is an isometric view of a completed carrier with the articles disposed therein.

In order to form the blank of FIG. 3 into the completed carrier as shown in FIG. 1, initially it is necessary to lower the blank onto the articles as disclosed and claimed in U.S. Patent Application Ser. No. 963,004 filed Nov. 22, 1978, in which machine elements engage and fold bend lines B and B1 downwardly to form troughs aligned with the associated apertures which facilitate upward folding of tabs 46 and 48 and urge tabs 49 and 50 toward the adjacent bottle necks. Downward movement of the blank tends to fold tab 47 upwardly due to engagement with the bottle but such folding is resisted due to the V-shaped fold line 52.

Figure 2:
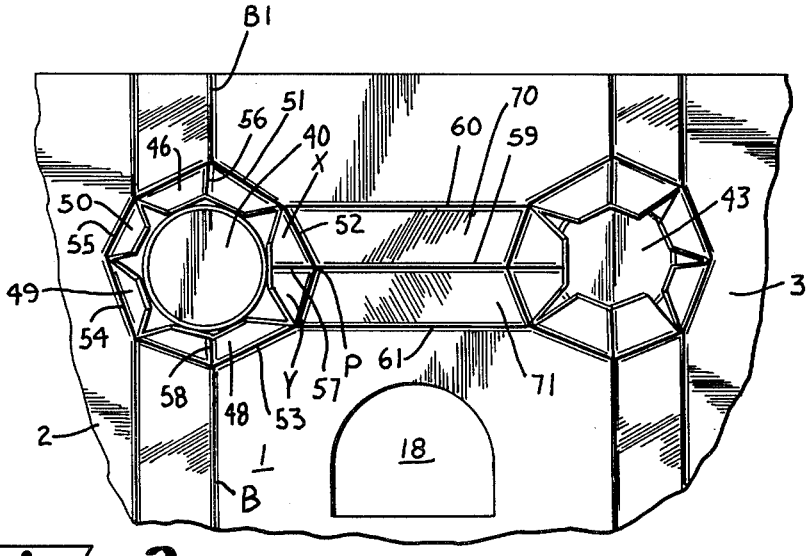
FIG. 2 is an enlarged fragmentary view of a portion of the carrier with an article partially loaded therein.

According to this invention and as best viewed in FIG. 2, blank portions 70 and 71 are manipulated into a V-shaped formation defined by bend line extension 59 and auxiliary bend lines 60 and 61 as the blank is lowered about the articles which relieves the normal resistance of transverse retention tab 47 to bend upwardly along V-shaped fold line 52. This results from the natural tendency of the blank to bend along bend lines 59, 60, and 61 as the blank is formed around the upper portions of the articles by operation of forming machine elements acting along bend lines B and by the upward force of article cap C on transverse retention tab 47 which in effect causes medial bend line 57 and bend line extension 59 to pivot downwardly at point P. Therefore the associated article can easily enter the neck receiving aperture 40 and form the desired locked formation therewith.

In order to complete the formation of the carrier, and after the neck receiving apertures are disposed in enveloping relationship around the necks of the articles, side panel 3, top panel 8, sloping panel 12 and auxiliary top panel 16 are all elevated and folded over along fold lines 5, 9, 13, and 17 respectively. As this occurs, the inwardly facing portion of each article cap C centers the respective cap receiving apertures 34, 35, and 36. Following this side panel 2, top panel 6, sloping panel 10, and auxiliary top panel 14 are folded respectively upwardly along fold lines 4, 7, 11, and 15. Simultaneously the inwardly facing portions of the article caps C on the other side of the carrier enter the respective cap receiving apertures 28, 29, and 30. Then tabs 62, 63, 64, and 65 are slipped into slots 66, 67, 68, and 69 respectively. Formation of the carrier is then complete and the articles are held firmly in place since the top edges of retention tabs 46–50 together with cap engaging edge 31 are disposed in a firm gripping relationship with the lower edge of the article cap C situated in neck receiving aperture 40. Of course the remaining articles are similarly held in position. Cushioning flaps 24 and 25 are driven through finger gripping apertures 18 and 19 and the finger gripping notches 20 and 21 to interlock the bottom panel and the auxiliary top panels 14 and 16.

Due to the stabilizing effect of bend lines B and B1 and of the transverse bend lines 59 and of the tendency to establish longitudinal and transverse troughs the carrier is rendered particularly stable and mechanically strong and also is well suited for stacking one atop another.

INDUSTRIAL APPLICABILITY

By this invention an article carrier is provided which is economical to produce and quite easy to form and which is well suited for use in the plant of a bottler where the blanks are normally applied to groups of bottles.

I claim:

1. An article carrier blank comprising a bottom panel (1), a pair of side panels (2,3) foldably joined respectively to the longitudinal side edges of said bottom panel, a pair of top panels (6,8) foldably joined respectively to the longitudinal edges of said side panels remote from said bottom panel, a neck receiving aperture (40–45) formed in said bottom panel, a transverse retention tab (47) foldably joined to said bottom panel along a V-shaped fold line (52) and disposed in said neck receiving aperture, and characterized in that a medial bend line (57) is formed in said transverse retention tab and a bend line extension (59) is formed in said bottom panel and is disposed in alignment with said medial bend line and a pair of auxiliary bend lines (60,61) are formed in said bottom panel and extend from the ends of said V-shaped fold line and are disposed substantially parallel to said bend line extension.

2. An article carrier blank according to claim 1 and further characterized in that a pair of sloping panels (10,12) are foldably joined respectively to said pair of top panels along the longitudinal edges thereof remote from said side panels and a pair of auxiliary top panels (14,16) are foldably joined respectively to said pair of sloping panels along the longitudinal edges thereof remote from said top panels.

3. An article carrier blank according to claim 2 and further characterized in that a cap receiving aperture (28–30, 34–36) is formed in said sloping panels.

4. An article carrier blank according to claims 1 or 3 and further characterized in that a pair of finger gripping apertures (18,19) are formed in said bottom panel.

5. An article carrier blank according to claim 4 wherein cushioning flaps (24,25) are provided in said one of said auxiliary top panels and disposed to coincide with said finger gripping apertures (18,19) when a carrier is formed from the blank.

6. A blank for a top gripping carrier for at least four bottles arranged in two rows of two bottles each and having caps with peripheral projections, said blank comprising a bottom panel (1), a pair of side panels (2,3) foldably joined respectively to the longitudinal side edges of the bottom panel, a pair of top panels (6,8) foldably joined respectively to the longitudinal edges of said side panels remote from said bottom panel, at least two neck receiving apertures (40,41,42,43,44) formed in the bottom panel adjacent each side wall panel to form two longitudinal rows of apertures, a transverse retention tab (47) foldably joined to said bottom panel along a V-shaped fold line and associated with each of said apertures and disposed in the inner parts thereof, and characterized in that each of said tabs (47) includes a medial bend line (57) and a transverse bend line (59) is formed in said bottom panel and in alignment with the bend lines of oppositely disposed apertures in different rows of apertures and an auxiliary bend line (60,61) is formed in said bottom panel on each side of each of said transverse bend lines (59) and in substantially parallel relation therewith.

7. A blank according to claim 6 and further characterized in that the ends of said auxiliary bend lines coincide with the ends of said V-shaped fold lines.

8. A blank according to claim 6 and further characterized in that each end of each of said transverse bend lines coincides approximately with the apex (P) of the fold line of the adjacent tab.

* * * * *